US007568247B2

(12) United States Patent
Strobel et al.

(10) Patent No.: US 7,568,247 B2
(45) Date of Patent: Aug. 4, 2009

(54) BARIATRIC PATIENT MANAGEMENT SYSTEM

(75) Inventors: Frederic W. Strobel, Montpelier, OH (US); Steven W. Cotter, Bryan, OH (US)

(73) Assignee: Gendron, Inc., Bryan, OH (US)

( * ) Notice: Subject to any disclaimer, the term of this patent is extended or adjusted under 35 U.S.C. 154(b) by 291 days.

(21) Appl. No.: 10/541,041

(22) PCT Filed: Dec. 23, 2003

(86) PCT No.: PCT/US03/41169

§ 371 (c)(1),
(2), (4) Date: Dec. 12, 2005

(87) PCT Pub. No.: WO2004/060257

PCT Pub. Date: Jul. 22, 2004

(65) Prior Publication Data

US 2006/0168728 A1 Aug. 3, 2006

Related U.S. Application Data

(60) Provisional application No. 60/436,555, filed on Dec. 26, 2002.

(51) Int. Cl.
*A61G 7/00* (2006.01)

(52) U.S. Cl. ..... 5/613; 5/617; 5/618

(58) Field of Classification Search ..... 5/613, 5/614, 616–618, 658
See application file for complete search history.

(56) References Cited

U.S. PATENT DOCUMENTS

RE5,275 E 2/1873 Caro
348,418 A 8/1886 Rickey
517,280 A 3/1894 Karp
574,999 A 1/1897 Lamkin et al.
751,222 A 2/1904 Thompson
775,466 A 11/1904 Bent
789,173 A 5/1905 Rudnitzky
984,698 A 2/1911 Plunkett
985,749 A 2/1911 Mitchell
1,037,283 A 9/1912 McKnight
1,138,030 A 5/1915 Weston
1,413,595 A 4/1922 Kreuzkamp
1,479,344 A 1/1924 Walton
1,721,647 A 7/1929 Stolenberg
1,973,699 A 9/1934 Bradley
2,784,419 A 3/1957 Cimon (Continued)

FOREIGN PATENT DOCUMENTS

DE 3510014 A1 9/1986

(Continued)

*Primary Examiner*—Patricia L Engle
*Assistant Examiner*—Gilbert Y Lee
(74) *Attorney, Agent, or Firm*—Fraser Clemens Martin & Miller LLC; J. Douglas Miller

(57) ABSTRACT

A bariatric bed having extensible side portions and extensible end portions which facilitate an expansion of the overall width and length of the bed to comfortably support an obese patient, the side portions capable of being retracted to reduce the overall width of the bed to fit through a standard hospital door opening, the bed including a plurality of load cells which transmit a signal to a weigh scale to provide a readout of the weight of the patient.

14 Claims, 6 Drawing Sheets

U.S. PATENT DOCUMENTS

| | | | | | |
|---|---|---|---|---|---|
| 3,213,468 | A | | 10/1965 | Sevcik | |
| 3,505,694 | A | | 4/1970 | Pesta | |
| 3,644,946 | A | * | 2/1972 | Swatt | 5/616 |
| 3,668,719 | A | | 6/1972 | Romero | |
| 3,710,403 | A | | 1/1973 | Weidner et al. | |
| 3,729,751 | A | | 5/1973 | Kirkman | |
| 3,821,821 | A | | 7/1974 | Burst et al. | |
| 3,839,753 | A | | 10/1974 | Benoit et al. | |
| 3,875,598 | A | | 4/1975 | Foster et al. | |
| 3,921,230 | A | | 11/1975 | Hanning et al. | |
| 3,932,903 | A | * | 1/1976 | Adams et al. | 5/100 |
| 4,045,011 | A | | 8/1977 | Ford | |
| 4,196,484 | A | | 4/1980 | Harris | |
| 4,263,683 | A | | 4/1981 | Knoke | |
| 4,271,547 | A | | 6/1981 | Grossutti | |
| 4,409,695 | A | * | 10/1983 | Johnston et al. | 5/601 |
| 4,847,930 | A | * | 7/1989 | Spath | 5/84.1 |
| 4,866,796 | A | | 9/1989 | Robinson et al. | |
| 5,038,423 | A | | 8/1991 | Hall | |
| 5,042,097 | A | | 8/1991 | Fuchs | |
| 5,327,593 | A | | 7/1994 | Burnett | |
| 5,392,475 | A | | 2/1995 | McCall et al. | |
| 5,479,666 | A | * | 1/1996 | Foster et al. | 5/624 |
| 5,497,518 | A | | 3/1996 | Iura | |
| 5,611,096 | A | * | 3/1997 | Bartlett et al. | 5/617 |
| 5,729,849 | A | | 3/1998 | Garakani | |
| 5,737,781 | A | | 4/1998 | Votel | |
| 5,940,910 | A | * | 8/1999 | Weismiller et al. | 5/600 |
| 6,163,903 | A | * | 12/2000 | Weismiller et al. | 5/610 |
| 6,173,461 | B1 | * | 1/2001 | Alexander | 5/618 |
| 6,353,950 | B1 | * | 3/2002 | Bartlett et al. | 5/617 |
| 6,357,065 | B1 | | 3/2002 | Adams | |
| 6,728,985 | B2 | * | 5/2004 | Brooke et al. | 5/662 |
| 2001/0001163 | A1 | * | 5/2001 | Allen et al. | 5/624 |
| 2002/0138905 | A1 | * | 10/2002 | Bartlett et al. | 5/607 |
| 2006/0179576 | A1 | * | 8/2006 | Richards et al. | 5/662 |
| 2006/0195984 | A1 | * | 9/2006 | HakamiuN et al. | 5/430 |

FOREIGN PATENT DOCUMENTS

| | | | |
|---|---|---|---|
| DE | 3841396 | A1 | 4/1990 |

* cited by examiner

BARIATRIC PATIENT MANAGEMENT SYSTEM

CROSS-REFERENCE TO RELATED APPLICATION

This application claims the benefit of U.S. provisional patent application Ser. No. 60/436,555, filed Dec. 26, 2002, and is a National Stage Entry of PCT/US03/41169, filed Dec. 23, 2003.

FIELD OF THE INVENTION

The present invention relates to a patient management system and more particularly to a bariatric patient management system having extensible side portions and extensible end portions which expand the width and length of the system to facilitate supporting an obese patient.

BACKGROUND OF THE INVENTION

A growing number of people are becoming obese to the point bariatric surgery becomes necessary for the patient to lose weight and avoid a life of obesity. While the trend toward obesity concerns health experts throughout the world, obesity is being treated by bariatric surgery. Such surgery procedure involves the sealing off of eighty-five percent (85%) of the patient's stomach. In such procedures, it is necessary to support the patient during the surgical procedure and transport the patient before and after the surgical procedure and during convalescence.

Bariatrics is typically defined as the branch of medicine concerned with the management of obesity and allied diseases. The above referred example of bariatric surgery is only one of the examples of an instance where it becomes necessary to support persons of considerable weight. It has been found necessary to deal with persons weighing up to and exceeding one thousand pounds.

Accordingly, it has become necessary to develop beds, stretchers, chairs, and/or tables capable of supporting the weight of persons weighing up to and exceeding one thousand pounds.

Typically, a standard hospital bed can be adjusted to control both mattress contour and height above the floor. The standard hospital bed is rated for approximately 350 pounds of weight. When it is necessary for the hospital bed to be moved, it is transported by rolling on casters. The standard hospital bed is typically 39-inches wide so as to fit through a standard hospital door.

The bariatric bed must have the capabilities of the standard hospital bed. That is, the bariatric bed is capable of adjusting the contours of the mattress and raising or lowering the elevation of the mattress above the floor. However, the bariatric bed is typically wider than the standard hospital bed, thus restricting the mobility of the bariatric bed within the hospital. The bariatric bed can be as wide as 60-inches, thus being much wider than the standard hospital door.

It would be desirable to produce a bariatric bed which combines a full array of functions including: flat, seated, reclining, and trendelenburg positions for patient transfer, transportation, examination, treatment, surgery, procedural, and cardiac chair position, and wherein the mobility of the bariatric bed is maximized.

SUMMARY OF THE INVENTION

Consistent and consonant with the present invention, a bariatric bed which combines a full array of functions including: flat, seated, reclining, and trendelenburg positions for patient transfer, transportation, examination, treatment, surgery, procedural, and cardiac chair position, and wherein the mobility of the bariatric bed is maximized, has surprisingly been discovered.

The bariatric patient support system comprises: a body supporting main frame having a mattress supporting surface, the main frame including at least one of an extensible side pull out extension and an extensible end pull out extension to increase an area of the mattress supporting surface; a plurality of ground engaging wheels disposed on the mainframe to facilitate a transporting of the bariatric patient management system; and a plurality of actuators to effect a change in a contour of the mattress supporting surface of the main frame.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE PREFERRED EMBODIMENT

Figure 1:
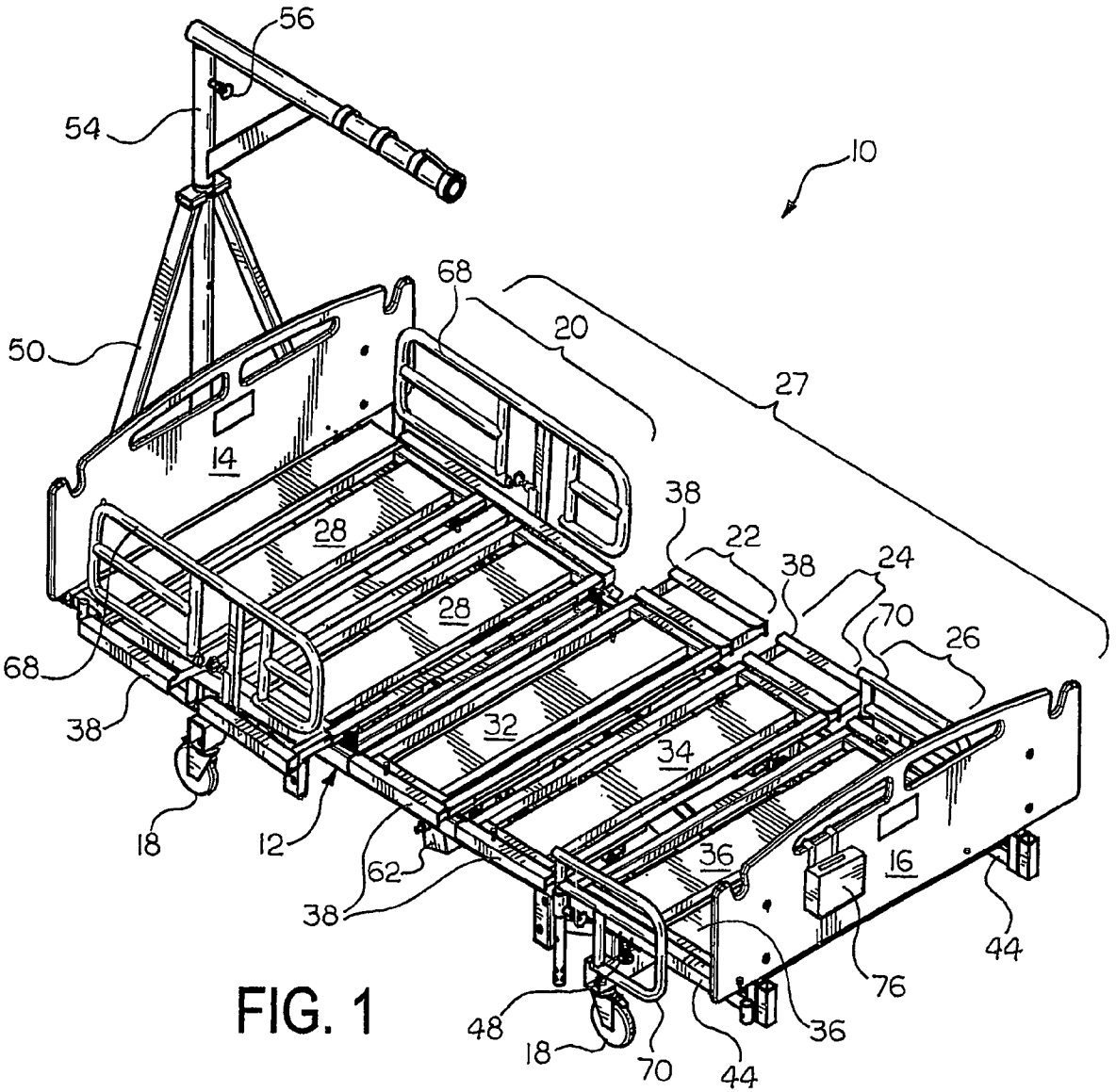
FIG. 1 is a top perspective view of a bariatric patient management system for supporting a bariatric patient in accordance with the present invention.

Referring now to FIG. 1, there is shown generally at 10 a top perspective view of a bariatric patient management system or bed in accordance with the present invention. The bariatric patient management system 10 includes a body supporting main frame 12, a headboard 14, a footboard 16, and ground engaging wheels or casters 18 for supporting a patient, as clearly illustrated in FIGS. 1, 2, 3, and 4.

The main frame 12 can be of solid or split construction and includes a backrest section 20, a middle section 22, a leg section 24, and a foot section 26 disposed thereon. The backrest section 20, the middle section 22, the leg section 24, and the foot section 26 cooperate to form a mattress supporting surface 27 for the bariatric patient management system 10. The backrest section 20 includes a pair of backrest panels 28. A substantially planar surface is formed by the backrest panels 28. In the position shown in FIGS. 1 and 2, the backrest panels 28 are parallel with a supporting surface 30 such as a floor, for example. Each of the middle section 22, the leg section 24, and the foot section 26 includes at least one respective middle panel 32, leg panel 34, and foot panel 36.

Figure 6:
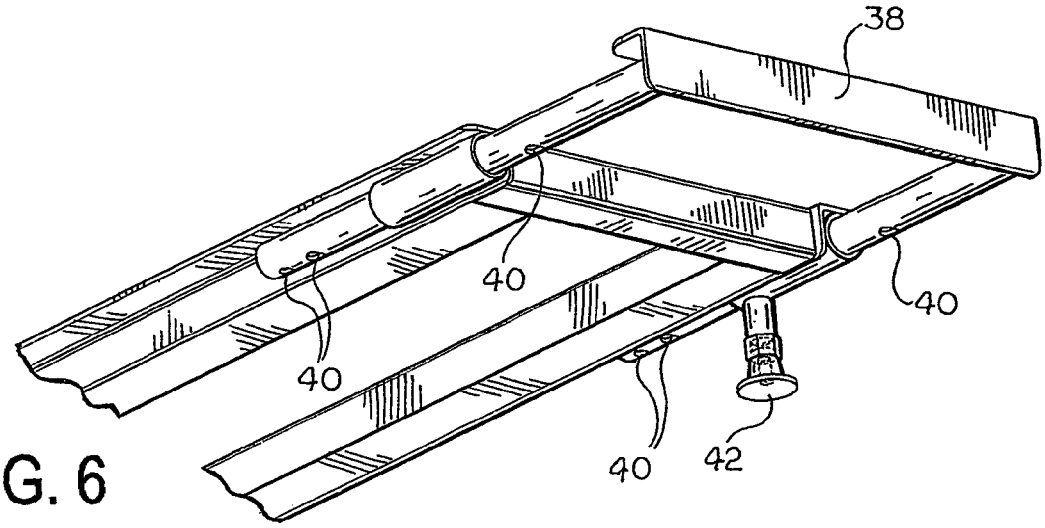
FIG. 6 is a partial perspective view of the bariatric patient management system illustrated in FIGS. 1, 2, 3, and 4 showing a pull out extension.

Both a first side and a second side of each of the backrest section 20, the middle section 22, the leg section 24, and the foot section 26 include an extensible side pull out extension 38. In the embodiment shown, the side pull out extension 38 telescopes outwardly. FIG. 6 shows a partial perspective view of the side pull out extension 38. A plurality of locking apertures 40 are disposed in the side pull out extension 38. A spring loaded locking pin 42 is disposed on the respective sections 20, 22, 24, 26 and cooperates with the apertures 40 to lock the side pull out extension 38 in a desired position. Other locking means may be used without departing from the scope and spirit of the invention. An extensible end pull out extension 44 is provided at an end of the main frame 12 adjacent the foot section 26. As illustrated in the drawings, the end pull out extension 44 telescopes outwardly. Referring to FIG. 3, a plurality of locking apertures 46 are shown which are disposed in the end pull out extension 44. A spring loaded locking pin 48 is disposed on the main frame 12 and cooperates with the apertures 46 to lock the end pull out extension 44 in a desired position, clearly shown in FIGS. 1-4. Other locking means may be used without departing from the scope and spirit of the invention. An extensible end pull out extension 44 can also be provided at an end of the main frame 12 adjacent the backrest section 20.

Figure 5:
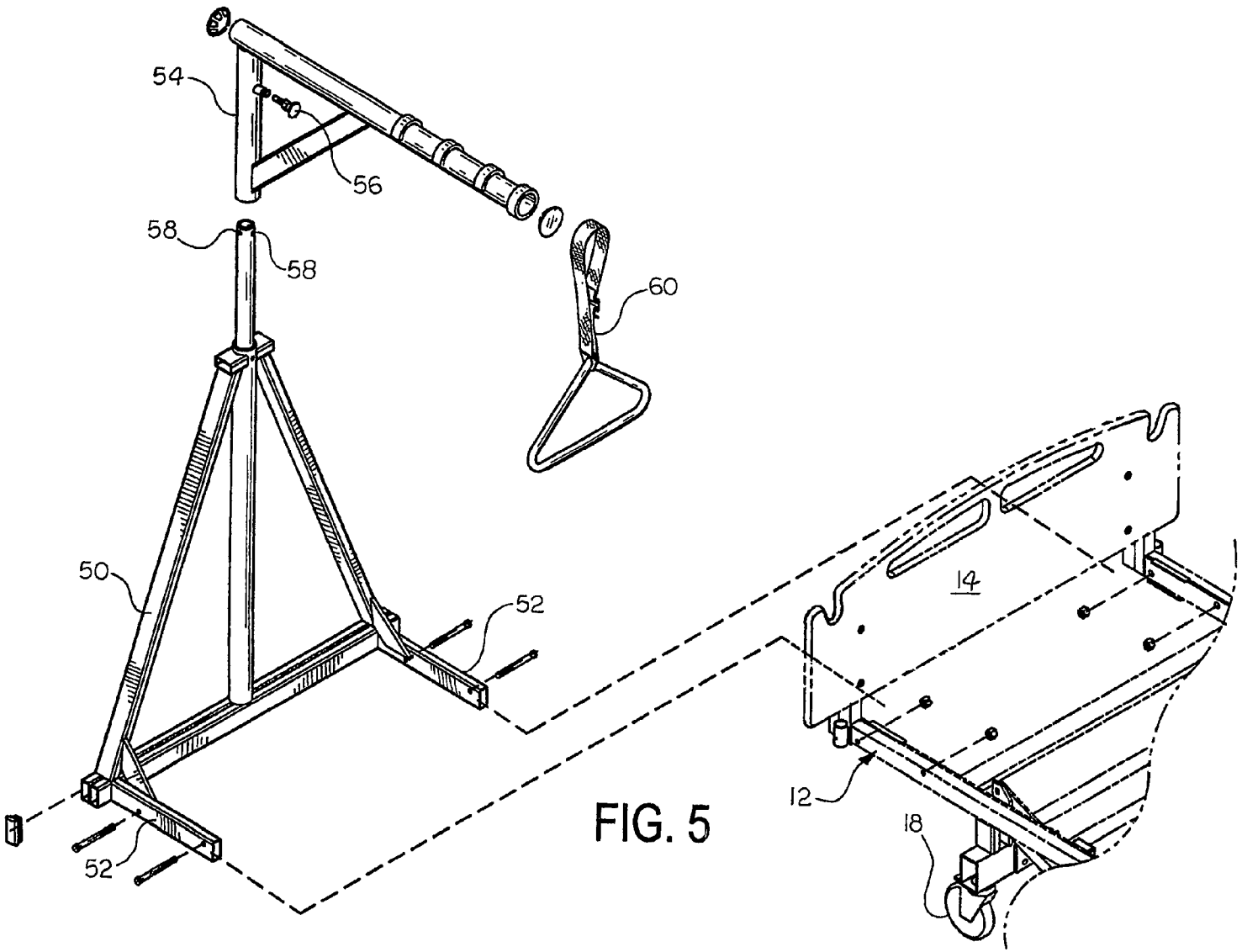
FIG. 5 is a partial exploded perspective view of the bariatric patient management system illustrated in FIGS. 1, 2, and 3 showing the boom assembly for the bariatric bed.

A trapeze base frame 50 is disposed on an end of the main frame 12 adjacent the backrest section 20. As shown in FIG. 5, outwardly extending arms 52 of the trapeze base frame 50 are received adjacent the main frame 12 and fastened thereto by any conventional fastening method such as threaded fasteners, for example. The trapeze base frame 50 and the arms 52 cooperate to facilitate a two-point mounting configuration. Common four-point mounting configurations require two additional mounting columns which obstruct access to the bariatric patient management system 10. A trapeze boom 54 is pivotally received on the trapeze base frame 50. A spring loaded locking pin 56 cooperates with apertures 58 formed in the trapeze base frame 50 to lock the trapeze boom 54 in a desired position. A trapeze bar assembly 60 depends from the trapeze boom 54.

Figure 2:
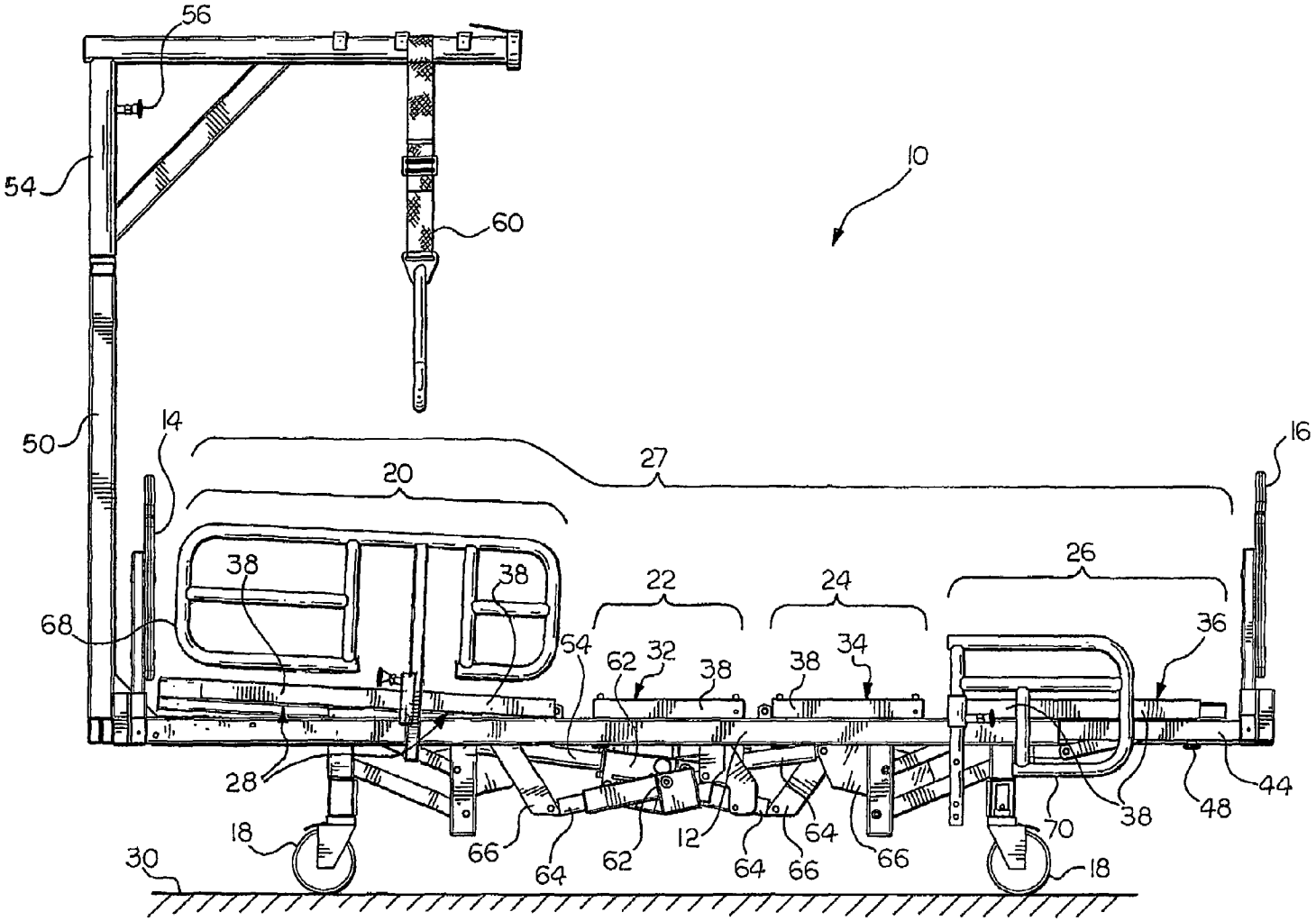
FIG. 2 is a side elevational view of the bariatric patient management system illustrated in FIG. 1, and showing a trapeze suspended from a boom assembly.
Figure 3:
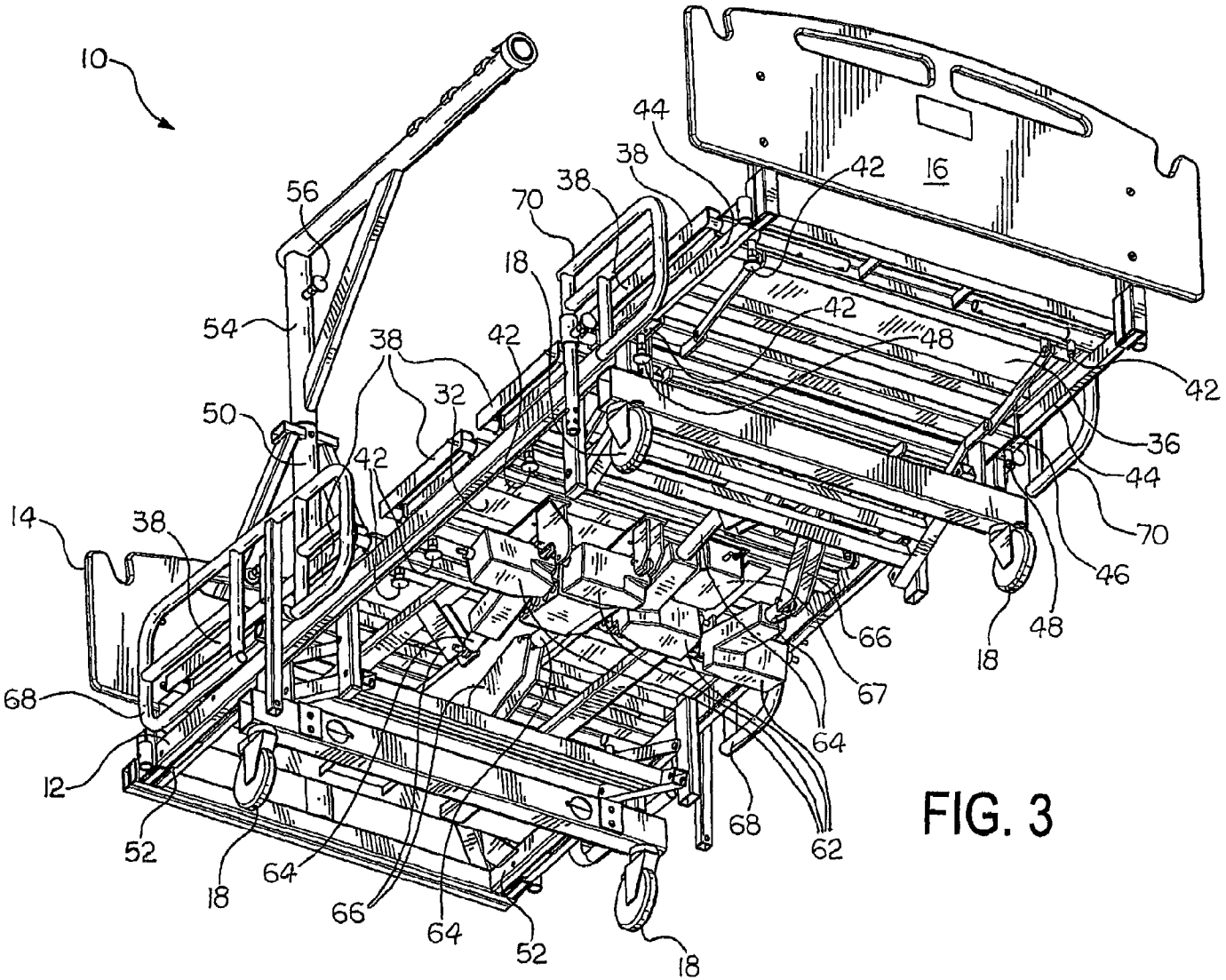
FIG. 3 is a bottom perspective view of the bariatric patient management system illustrated in FIG. 1.

Referring now to FIGS. 2 and 3, there is shown a plurality of actuators 62. Each of the actuators 62 includes an actuator arm 64 which is operatively engaged with a linkage member 66. The linkage member 66 operatively links the actuator arm 64 with a respective one of the backrest section 20, the leg section 24, the foot section 26, and the main frame 12 to cause an inclination of the respective one of the backrest section 20, the leg section 24, the foot section 26, and the main frame 12 upon actuation of the actuator arm 64. A controller 67 is provided to control actuation of the actuators 62. The actuators 62 can be a push type actuator, a pull type actuator, or a push/pull type actuator as desired. In the embodiment shown, the actuators 62 are push/pull type actuators. It is understood that electrical actuators, hydraulic actuators, a combination thereof, or other actuators can be used without departing from the scope and spirit of the invention.

FIGS. 1-4 show a pair of side rails 68 adjustably connected to each side of the side pull out extension 38 adjacent the backrest section 20 for the safety of the patient. The side rails 68 can be placed in multiple positions. To facilitate transport, the side rails 68 can be dropped down into the side pull out extension 38 to facilitate a width of 39 inches to fit through a standard 42-inch door. An ingress/egress bar 70 is pivotally mounted to each side of the side pull out extension 38 adjacent the foot section 26 to assist with ingress and egress of the patient for the bariatric patient management system 10.

Figure 4:
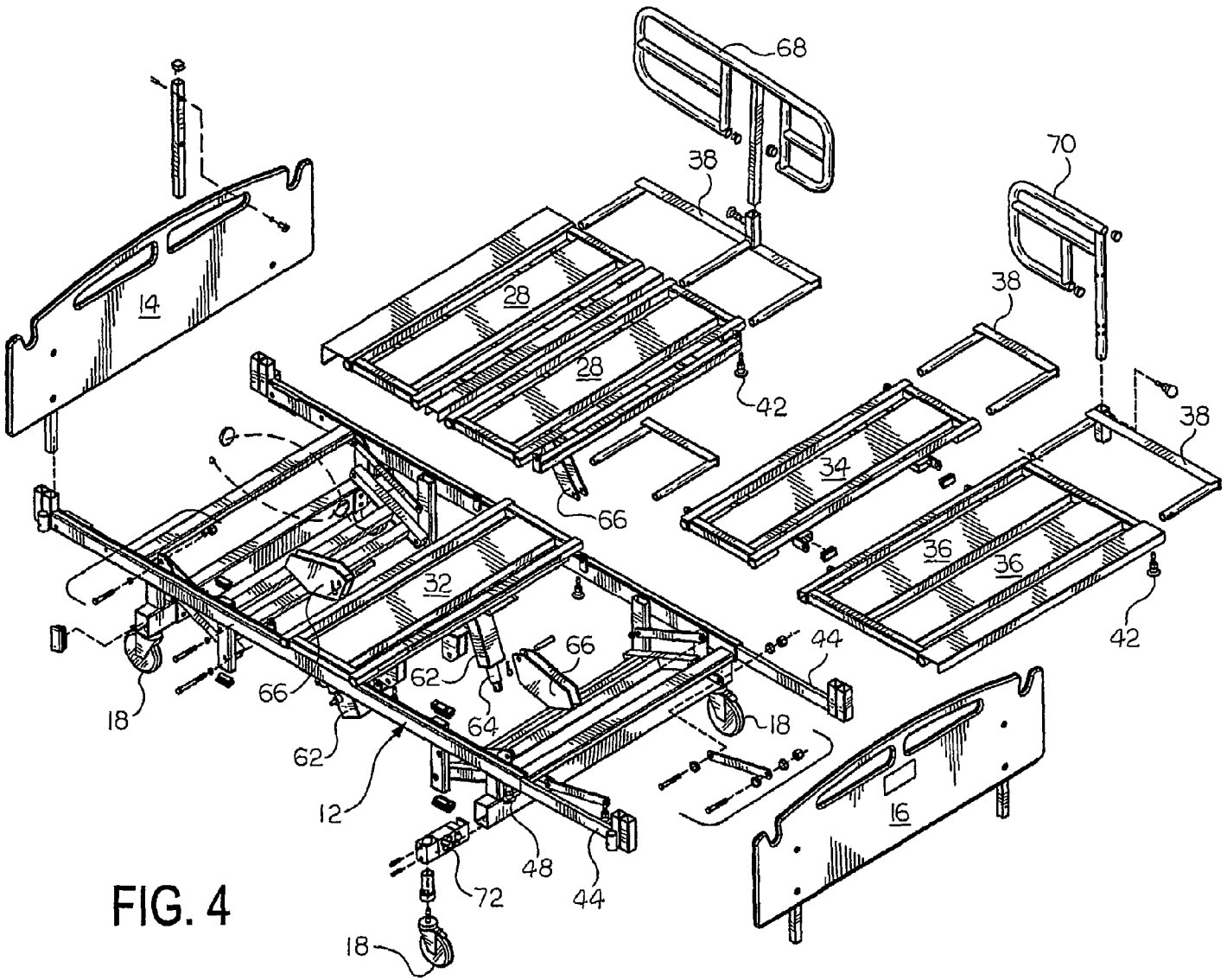
FIG. 4 is a partial exploded perspective view of the bariatric patient management system illustrated in FIG. 1.
Figure 7:
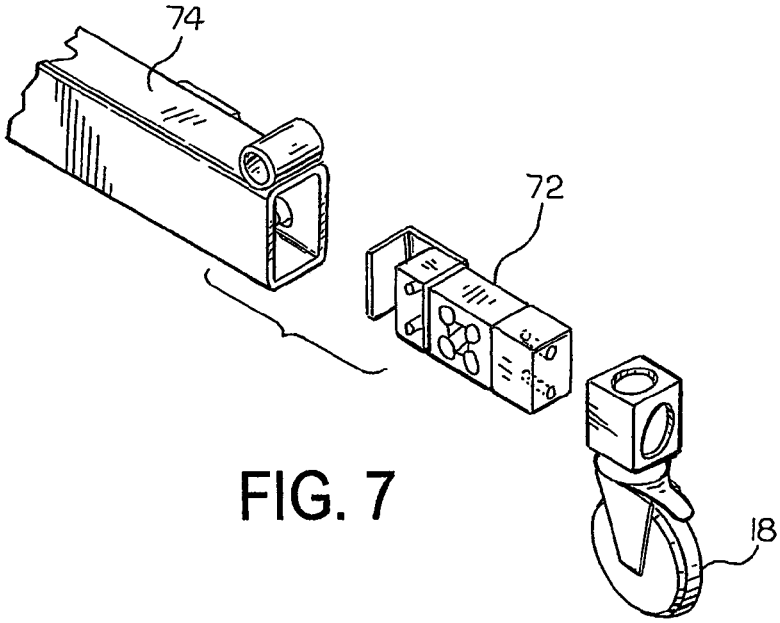
FIG. 7 is a partial exploded perspective view of a load cell and wheel assembly for the bariatric patient management system illustrated in FIG. 1.
Figure 8:
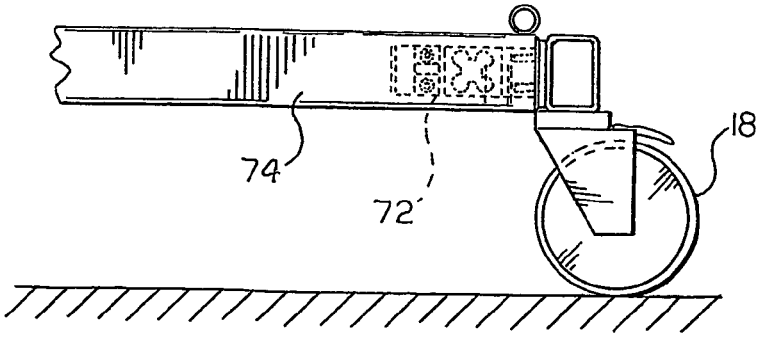
FIG. 8 is a side elevational view of the load cell and wheel assembly illustrated in FIG. 7.

A load cell 72 is connected to each of the wheels 18 as illustrated in FIG. 4. FIG. 7 shows a partial exploded perspective view and FIG. 8 shows a side elevational view of the load cell 72 and the wheel 18. A cross member 74 is connected to the main frame 12. The load cell 72 is disposed in the cross member 74 and the wheel 18 is connected to the load cell 72 by any conventional fastening method such as threaded fasteners, for example. Thus, the load of the bariatric patient management system 10 is transmitted through the load cell 72. The load cell 72 is electrically connected to a weight display unit 76, as shown in FIG. 1, such that a weight signal sent from the load cell 72 to the weight display unit 76 can be shown.

In operation, the bariatric patient management system 10 can be configured in a plurality of positions. The actuators 62 can be used to raise and lower the backrest section 20, the leg section 24, the foot section 26, or any combination thereof. Additionally, the bariatric patient management system 10 height can be raised or lowered. A trendelenburg position and a reverse trendelenburg position are also facilitated by operation of the actuators 62. The bariatric patient management system 10 can be configured as a chair to place the patient in a seated position.

The trapeze boom 54 is pivotally received on the trapeze base frame 50. Thus, during patient evaluation or ingress/egress, the trapeze boom 54 can be pivoted to the side to a position as desired. The spring loaded locking pin 56 cooperates with the apertures 58 to lock the trapeze boom 54 in the desired position.

Use of the side pull out extensions 38 facilitates a widening and narrowing of the mattress supporting surface 27 of the bariatric patient management system 10. Use of the end pull out extension 44 facilitates a lengthening and shortening of the bariatric patient management system 10. The ability to change the length and width of the bariatric patient management system 10 facilitates a larger patient, thus maximizing the comfort of the patient. The ability to change the length and width of the bariatric patient management system 10 also facilitates transport of the bariatric patient management system 10 as desired. During times of emergency or evacuation, health care providers may not have the time necessary to transfer a patient to a wheel chair or other transporting device. By providing a quick and easy adjustment method, safety and flexibility of transport are maximized.

The bariatric patient Management system 10 can also be provided with an optional 24-volt electric powered drive wheel (not shown) disposed on at least one of the wheels 18 to assist the health care provider during transport of the patient. Other features provided include special openings provided in the headboard 14 and the footboard 16 to mount patient various devices such as the display unit 76, for example. A CPR quick release backrest (not shown) with a cable release backrest adjacent the foot section 26 is also provided. A safety battery back up (not shown) can be used to raise or lower a desired section of the bed and/or the bed height in an emergency.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A bariatric patient management system comprising:

a main frame having a first end and a second end;

a backrest section disposed on said main frame adjacent the first end, said backrest section including at least one backrest panel, a backrest side pull out extension slidingly disposed in a side of the backrest section, and a backrest actuator linked to said backrest section to selectively cause an inclination of said backrest panel;

a middle section disposed on said main frame adjacent said backrest section, said middle section including at least one middle panel and a middle side pull out extension slidingly disposed in a side of the middle section;

a leg section disposed on said main frame adjacent said middle section, said leg section including at least one leg panel, a leg side pull out extension slidingly disposed in a side of the leg section, and a leg actuator linked to said leg section to selectively cause an inclination of said leg panel;

a foot section disposed on said main frame adjacent the leg section and the second end of said main frame, said foot section including at least one foot panel, a foot side pull out extension slidingly disposed in a side of the foot section;

ground engaging wheels disposed on said main frame to facilitate a transporting of the bariatric patient management system;

an extensible end pull out extension slidingly disposed in one of the first end and the second end of said main frame, said extensible end pull out extension facilitating a lengthening and shortening of the bariatric patient management system;

a side rail adjustably connected to the backrest side pull out extension, said side rail dropped down into a side pull out extension conduit coupled to the side pull out extension, said side rail slidingly disposed within the side pull out extension conduit and having a plurality of positions, wherein the side rail does not pivot within the side pull out extension conduit; and an ingress/egress bar adjustably connected to the foot side pull out extension, said ingress/egress bar dropped down into a foot side pull out extension conduit coupled to the foot side pull out extension, said ingress/egress bar slidingly disposed within the foot side pull out extension conduit and having a plurality of positions, wherein said ingress/egress bar also pivots within the foot side pull out extension, wherein the backrest panel, the middle panel, the leg panel, and the foot panel cooperate to form a mattress supporting surface, and said backrest side pull out extension, said middle side pull out extension, said leg side pull out extension, and said foot side pull out extension cooperate to selectively increase a width of the mattress supporting surface.

2. The bariatric patient management system according to claim 1, further comprising a trapeze base frame having a two-point mounting configuration.

3. The bariatric patient management system according to claim 2, wherein said trapeze base frame includes a pivotally mounted trapeze boom.

4. The bariatric patient management system according to claim 3, wherein the trapeze base frame includes a plurality of apertures formed therein, a spring loaded locking pin selectively cooperating with one of the plurality of apertures to lock the trapeze boom in a desired position.

5. The bariatric patient management system according to claim 2, wherein the trapeze base frame includes a pair of fixed outwardly extending arms, one of the outwardly extending arms received adjacent a first side of the base frame and the other of the outwardly extending arms received adjacent a second side of the base frame, the first side of the base frame horizontally spaced from the second side of the base frame.

6. The bariatric patient management system according to claim 1, wherein said actuators are at least one of a push actuator and a pull actuator.

7. The bariatric patient management system according to claim 1, wherein said actuators are electric actuators.

8. The bariatric patient management system according to claim 1, wherein said actuators are hydraulic actuators.

9. The bariatric patient management system according to claim 1, further comprising at least one load cell mounted between said wheels and said main frame.

10. The bariatric patient management system according to claim 9, wherein the main frame includes a hollow member supporting the load cell, wherein the load cell is disposed within the hollow member.

11. The bariatric patient management system according to claim 1, including a motor to cause rotation of at least one of the wheels.

12. The bariatric patient management system according to claim 1, wherein the side pull out extension conduit has a spring loaded locking pin and the side rail has a plurality of apertures, the spring loaded locking pin selectively cooperating with the apertures to lock the side rail in one of the positions.

13. The bariatric patient management system according to claim 1, wherein the foot pull out extension conduit has a spring loaded locking pin and the ingress/egress bar has a plurality of apertures, the spring loaded locking pin selectively cooperating with the apertures to lock the ingress/egress bar in one of the positions.

14. A bariatric patient management system comprising:

a main frame having a first end and a second end;

a trapeze base frame having a two-point mounting configuration having a pair of fixed outwardly extending arms disposed on said main frame adjacent the first end, one of the outwardly extending arms received adjacent a first side of the base frame and the other of the outwardly extending arms received adjacent a second side of the base frame, the first side of the base frame horizontally spaced from the second side of the base frame;

a backrest section disposed on said main frame adjacent the first end, said backrest section including at least one backrest panel, a backrest side pull out extension slidingly disposed in a side of the backrest section, and a backrest actuator linked to said backrest section to selectively cause an inclination of said backrest panel;

a middle section disposed on said main frame adjacent said backrest section, said middle section including at least one middle panel and a middle side pull out extension slidingly disposed in a side of the middle section;

a leg section disposed on said main frame adjacent said middle section, said leg section including at least one leg panel, a leg side pull out extension slidingly disposed in a side of the leg section, and a leg actuator linked to said leg section to selectively cause an inclination of said leg panel;

a foot section disposed on said main frame adjacent the leg section and the second end of said main frame, said foot section including at least one foot panel, a foot side pull out extension slidingly disposed in a side of the foot section;

ground engaging wheels disposed on said main frame to facilitate a transporting of the bariatric patient management system;

at least one load cell mounted between one of said wheels and said main frame, wherein the main frame includes a hollow member and the load cell is disposed within the hollow member;

an extensible end pull out extension slidingly disposed in one of the first end and the second end of said main frame, wherein the extensible end pullout extension is disposed within the main frame and selectively telescopes outwardly therefrom, said extensible end pull out extension facilitating a lengthening and shortening of the bariatric patient management system;

a side rail adjustably connected to the backrest side pull out extension, said side rail dropped down into a side pull out extension conduit coupled to the side pull out extension, said side rail slidingly disposed within the side pull out extension conduit and having a plurality of positions, wherein the side rail does not pivot within the side pull-out extension conduit; and an ingress/egress bar adjustably connected to the foot side pull out extension, said ingress/egress bar dropped down into a foot side pull out extension conduit coupled to the side pull out extension, said side rail slidingly disposed within the side pull out extension conduit and having a plurality of positions, wherein said ingress/egress bar also pivots within the foot side pull out extension conduit, wherein the backrest panel, the middle panel, the leg panel, and the foot panel cooperate to form a mattress supporting surface, and said backrest side pull out extension, said middle side pull out extension, said leg side pull out extension, and said foot side pull out extension cooperate to selectively increase a width of the mattress supporting surface.

* * * * *